US007639221B2

(12) United States Patent
Aoki

(10) Patent No.: US 7,639,221 B2
(45) Date of Patent: Dec. 29, 2009

(54) METHOD OF DRIVING ELECTRO-OPTICAL DEVICE, ELECTRO-OPTICAL DEVICE, AND ELECTRONIC APPARATUS

(75) Inventor: Toru Aoki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 924 days.

(21) Appl. No.: 10/984,879

(22) Filed: Nov. 10, 2004

(65) Prior Publication Data

US 2005/0116944 A1 Jun. 2, 2005

(30) Foreign Application Priority Data

Nov. 13, 2003 (JP) ..... 2003-384062

(51) Int. Cl.
*G09G 3/36* (2006.01)

(52) U.S. Cl. ..... 345/87; 345/58; 345/92

(58) Field of Classification Search ..... 345/58, 345/87, 92, 94–100, 204, 208–210
See application file for complete search history.

(56) References Cited

U.S. PATENT DOCUMENTS 5,892,493 A * 4/1999 Enami et al. ..... 345/94
5,959,600 A * 9/1999 Uchino et al. ..... 345/94
6,266,039 B1 7/2001 Aoki
6,512,505 B1 * 1/2003 Uchino et al. ..... 345/96
6,563,478 B2 5/2003 Aoki
6,847,344 B2 * 1/2005 Ha ..... 345/95
2001/0015711 A1 * 8/2001 Aoki ..... 345/92
2002/0024486 A1 * 2/2002 Aoki ..... 345/87
2002/0044123 A1 * 4/2002 Aoki ..... 345/89
2003/0151564 A1 * 8/2003 Yamashita et al. ..... 345/52

FOREIGN PATENT DOCUMENTS

JP A-2000-267067 9/2000
JP A-2001-343953 12/2001
WO WO 99/04384 1/1999

* cited by examiner

*Primary Examiner*—Amare Mengistu
*Assistant Examiner*—Hong Zhou
(74) *Attorney, Agent, or Firm*—Oliff & Berridge, PLC

(57) ABSTRACT

During a precharge period before selecting a scanning line, data lines are precharged to a second voltage after precharging the data lines to a first voltage. The timing when the first voltage is switched to the second voltage in the data line corresponding to one image-signal line is different from the timing when the first voltage is switched to the second voltage in the data line corresponding to another image-signal line.

8 Claims, 12 Drawing Sheets

METHOD OF DRIVING ELECTRO-OPTICAL DEVICE, ELECTRO-OPTICAL DEVICE, AND ELECTRONIC APPARATUS

BACKGROUND

The present invention relates to a technique of precharging data lines before sampling image signals into the data lines.

Display panels for performing a display using electro-optical variation of an electro-optical material, such as display panels using liquid crystal, can be classified into several kinds depending upon driving types thereof. However, active matrix display panels for driving pixel electrodes with three-terminal switching elements have approximately the following structure. That is, in this kind of liquid crystal panel, liquid crystal is interposed between a pair of substrates, and one substrate is provided with a plurality of scanning lines and a plurality of data lines to intersect each other. In addition, as shown in FIG. 10, pairs of a thin film transistor (hereinafter, referred to as "TFT") 116 and a pixel electrode 118 are provided to correspond to respective intersections between the scanning lines 112 and the data lines 114. The other substrate is provided with a transparent counter electrode (common electrode) 108 opposite to the pixel electrodes and the counter electrode is kept at a constant voltage LCcom. Furthermore, the respective opposite surfaces of both substrates are provided with an alignment film having been subjected to a rubbing process such that a major-axis direction of liquid crystal molecules is continuously twisted, for example, by about 90° between both substrates, while the respective rear-surface sides of both substrates are provided with a polarizer corresponding to the alignment direction, respectively.

For the purpose of convenient explanation, it is supposed that the total number of scanning lines 112 is "m" and the total number of data lines 114 is "6n" (m and n are integers, respectively). Then, the pixels are arranged in a matrix shape of m rows×6n columns correspondingly to the intersections between the scanning lines 112 and the data lines 114.

In order to reduce and prevent leakage of electric charges in a liquid crystal capacitor, a storage capacitor 119 is provided at each pixel. One end of the storage capacitor 119 is connected to the pixel electrode 118 (the drain of the TFT 116) and the other end thereof is grounded in common through a capacitor line 175.

Light passing between the pixel electrodes 118 and the counter electrode 108 is optically rotated by about 90° depending upon degrees of twist of liquid crystal molecules when an effective voltage value of the liquid crystal capacitor is zero, while the liquid crystal molecules are inclined in an electric-field direction as the effective voltage value is increased, so that the optical rotation disappears. For this reason, for example, in a transmissive liquid crystal panel, in a case of a normally-white mode where polarizers of which polarizing axes are perpendicular to each other correspondingly to an alignment direction are disposed at the incident side and the rear-surface side, respectively, the light is transmitted when the effective voltage value of the liquid crystal capacitor is zero, so that a white color is displayed (the transmittance becomes large). As the effective voltage value is increased, the quantity of transmitted light is decreased, so that a black color is displayed (the transmittance is minimized). Therefore, by applying image signals with voltages corresponding to grayscale levels (or brightness) of pixels to the pixel electrodes 118 via the data lines 114 and controlling the effective voltage value of the liquid crystal capacitor in units of a pixel, a predetermined display is possible.

Since the liquid crystal capacitor is basically AC-driven, the image signals applied to the pixel electrodes 118 have a voltage range shown in FIG. 11 and alternately take a high-potential side voltage and a low-potential side voltage about a reference voltage Vc which is a about of amplitude. Here, the writing when the voltages applied to the pixel electrodes 118 become higher than the voltage Vc is referred to as a positive writing and the writing when the voltages applied to the pixel electrodes 118 become lower than the voltage Vc is referred to as a negative writing. The reference voltage Vc may be considered as the voltage LCcom of the counter electrode 108, but may be slightly different depending upon characteristics of the TFT 116.

Here, supposed that the ground voltage which is the low potential side of a source voltage is 0V and the high potential side is 14V, the image signal allowing a pixel to display a black color which is the lowest grayscale level in the negative writing have, for example, 2V. Similarly, the image signals allowing a pixel to display a white color which is the highest grayscale level in the negative writing, to display a white color in the positive writing, and to display a black color in the positive writing have 6V, 8V, and 12V, respectively, and the reference voltage is 7V. These voltage values are determined for the purpose of convenience.

This kind of liquid crystal panel has a problem that display quality is deteriorated due to a so-called vertical cross-talk. The vertical cross-talk is a phenomenon that for example, as shown in FIG. 12, when a black area is intended to be displayed in a window against a gray background having the same grayscale level, gray areas adjacent to the top and bottom of the black area become brighter than other gray areas.

For the purpose of convenient explanation, in FIG. 12, a display area 100*a* is divided into areas A, B, and C in the horizontal scan direction and is also divided into areas D, E, and F in the vertical scan direction. Total nine areas are specified by an area of the horizontal scan direction and an area of the vertical scan direction. For example, the black area which is displayed in a window can be marked by (B-E).

The major cause for the vertical cross-talk is leakage of light from the TFT 116 interposed between the pixel electrodes 118 ad the data lines 114. Specifically describing the leakage of light, the gate-source voltage $V_{DS}$ of a TFT and the drain current ID generally have a characteristic relation indicated by a solid line in FIG. 13. Since poly silicon constituting a TFT has a light-transmitting property, a black matrix is provided such that light is not incident to a channel portion of the TFT. However, since it is difficult to completely intercept the light, the characteristic is shifted to left as indicated by a dotted line. Even when the characteristic is shifted, the drain current $I_D$ little flows if the source (data line) voltage is still lower than the gate (scanning line) voltage, but the drain current $I_D$ flows if the source voltage is slightly lower than the gate voltage. That is, the off resistance is decreased.

Here, in a case where performing the display shown in FIG. 12, when the scanning lines belonging to the area B are selected and the voltage (2V) corresponding to a positive black color is sampled into the data lines belonging to the area E, the voltages of the scanning lines belonging to the areas A and C are not selected, so that the low-potential voltage of the source voltage is 0V. Accordingly, since the gate voltage is slightly lower than the source voltage in the TFTs belonging to the gray areas (A-E) and (C-E), the off resistances thereof are decreased in the TFTs of the above areas and the voltages of the pixel electrodes 118 become close to the voltage of the counter electrode, so that the effective voltage value applied to the liquid crystal capacitor is decreased.

On the contrary, since the voltage corresponding to a negative black color is never sampled into the data lines belonging to the areas D and F, the off resistances of the TFTs belonging to the gray areas (A-D), (B-D), (C-D), (A-F), (B-F), and (C-F) are not decreased. As a result, the effective voltage value applied to the liquid crystal capacitor is not decreased as much.

Therefore, in a normally-white mode, the pixels of the gray areas (A-E) and (C-E) are brighter than the pixels of the gray areas (A-D), (B-D), (C-D), (A-F), (B-F), and (C-F) due to decrease in the effective voltage value.

On the other hand, since a parasitic capacitor exists in the respective data lines, the time required for sampling the image signals into the data lines is elongated, and since the voltages of the image signals sampled right before remain in the data lines, the voltages of the data lines (pixel electrodes) when the image signals are subsequently sampled are changed. In order to prevent these problems, there has been known a technology of precharging the data lines with a constant voltage.

Here, as the voltage for precharging the data lines, a voltage (9V) corresponding to a positive gray color is preferably considered for performing the positive writing and a voltage (5V) corresponding to a negative gray is preferably considered for performing the negative writing. The reason is that in the characteristic relation (V-T characteristic) between the effective voltage value applied to the liquid crystal capacitor and the transmittance thereof, the variation of the transmittance relative to the effective voltage value is maximized when the gray color is displayed (when the transmittance is 50%). The reason is also that by precharging the data lines to the voltage (5V or 9V) corresponding to a gray color in advance, the image signals of the voltage corresponding to a gray color can be sampled into the data lines with a high speed and an intermediate grayscale level can be accurately displayed.

As the voltage for precharging the respective data lines in this way, the voltage corresponding to a gray color is preferably considered, but in order to make the vertical cross-talk invisible, there has been also suggested a technology of applying the voltage (2V) corresponding to a black color as the precharge voltage before performing the negative writing.

In this way, by precharging the voltage corresponding to a black color before performing the negative writing, in the TFTs of the gray areas (A-D), (B-D), (C-D), (A-F), (B-F), and (C-F), the gate voltage is also lower by 2V than the source voltage and thus the off resistance is decreased, similarly to the TFTs belonging to the gray areas (B-F) and (C-F). For this reason, the gray areas (A-D), (B-D), (C-D), (A-F), (B-F), and (C-F) become bright due to decrease in the effective voltage value applied to the liquid crystal capacitor, similarly to the gray areas (B-F) and (C-F). As a result, difference in grayscale level between the gray areas disappears, so that the vertical cross-talk is invisible.

Considering that the voltage (2V) corresponding to a black color is used as the precharge voltage of the negative writing in order to make the vertical cross-talk invisible, an ideal gray color is displayed at the positive writing by using the voltage corresponding to a white color, that is, an amplitude-about voltage as needed, as the precharge voltage of the positive writing.

SUMMARY

Recently, in order to secure the time for dot-sequentially sampling the image signals into the data lines, for example, as shown in FIG. 14, a phase-developing structure where the data lines are classified into blocks in units of a predetermined number of data lines (for example, six data lines), the blocks are sequentially selected during the period when one scanning line 112 is selected, and the image signals are sampled into the data lines in units of a block, is employed. In this phase-developing structure, the image signal of one system is distributed into six channels (phases) corresponding to the number of data lines 114 included one block, and the distributed image signals are expanded to six times on the temporal axis and then are supplied to the image-signal lines 171. Therefore, when one block is selected, the image signals expanded to six times are sampled correspondingly to the six data lines 114 included in the block, so that in comparison with the structure that the data lines are selected one by one and the image signals are sampled, it is possible to elongate the time for sampling to six times. Here, the number of data lines included in one block is "6", but is not limited to this number.

However, in the phase-developing structure, since the image signals are simultaneously sampled into the data lines 114 included in one block, the grayscale level of a pixel positioned at a specific data line in one block is different from the grayscale level of a pixel positioned at another data line even when it is intended to display the same grayscale level, so that this difference in grayscale level might be visible as a vertical stripe stain (vertical stripe pattern).

The present invention is contrived to solve the above problems and it is an object of the present invention to provide a method of driving an electro-optical device, an electronic-optical device, and an electronic apparatus, which can make the vertical cross-talk and the vertical stripe pattern invisible.

In order to accomplish the above object, according to the present invention, there is provided A method of driving an electro-optical device having a plurality of pixels provided correspondingly to intersections between a plurality of scanning lines and a plurality of data lines, which are classified into blocks in units of a predetermined number of data lines, comprising: distributing image signals into channels corresponding to the predetermined number of data lines and supplying the distributed image signals to image-signal lines of a number equal to the predetermined number, during a precharge period before selecting the scanning line, precharging the data lines to a second voltage after precharging the data lines to a first voltage, and the timing when the first voltage is switched to the second voltage in the data line corresponding to one channel is different from the timing when the first voltage is switched to the second voltage in the data line corresponding to another channel, selecting the scanning line after the precharge period, during a selection period when the scanning line is selected, selecting the blocks sequentially and sampling the image signals supplied to the image-signal lines into the data lines belonging to the selected block, and supplying the image signals to the pixels via the data lines.

According to this method, the vertical cross-talk is made to be invisible due to precharge of the first voltage. When signals corresponding to the same grayscale level are supplied to the pixels but the level of brightness of the pixel positioned on the data line corresponding to one channel is different from the level of brightness of the pixel positioned on the data line corresponding to another channel, it is possible to remove the difference in brightness by making different the timing for switching the voltage of the data line corresponding to the one channel in accordance with the brightness difference.

In the present invention, each pixel may have a liquid crystal capacitor interposed between a pixel electrode and a counter electrode and a switching element electrically turned on between the corresponding data line and the pixel electrode when the corresponding scanning line is selected, and when a higher voltage than the voltage of the counter electrode is written to the pixel electrode, the first voltage may be made to be higher than the second voltage during a precharge period before the effective horizontal scan period, and when a lower voltage than the voltage of the counter electrode is written to the pixel electrode, the first voltage is made to be lower than the second voltage during the precharge period before the writing.

One channel may be changed during each precharge period. According to this method, since pixels having different grayscale levels are shifted, an oblique stripe pattern is generated. For this reason, even when the vertical stripe pattern is generated, it is possible to make the vertical stripe pattern invisible by means of synchronization with the oblique stripe pattern.

On the other hand, the second voltage may be a voltage allowing a pixel to correspond to the voltage of an intermediate grayscale level between the highest grayscale level and the lowest grayscale level in an image signal. According to this method, it is possible to reproduce the intermediate grayscale level more accurately.

The present invention can be embodied as the method of driving an electro-optical device, a driving circuit of an electro-optical device, and the electro-optical device itself. Furthermore, since an electronic apparatus according to the present invention may have a display panel of the electro-optical device as a display unit, it is also possible to make the vertical cross-talk and the vertical stripe pattern invisible.

DETAILED DESCRIPTION OF EMBODIMENTS

Figure 1:
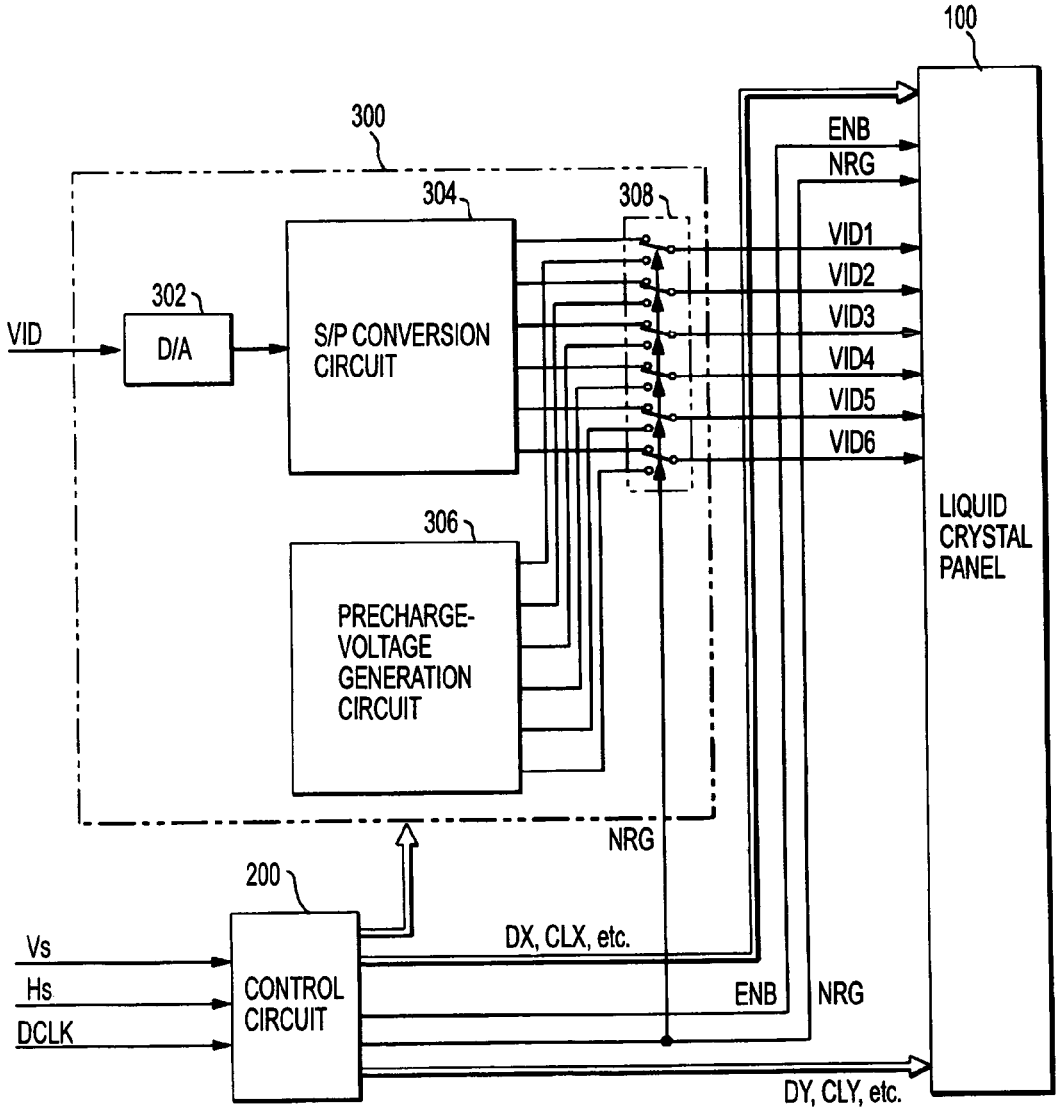
FIG. 1 is a block diagram illustrating the whole structure of an electro-optical device according to an embodiment of the present invention.

Hereinafter, embodiments of the present invention will be described with reference to the accompanying drawings. FIG. 1 is a block diagram illustrating the whole structure of an electro-optical device according to the present embodiment.

As shown in the figure, the electro-optical device comprises a liquid crystal panel 100, a control circuit 200, and an image-signal processing circuit 300. The control circuit 200 generates timing signals or clock signals for controlling respective parts from a vertical scan signal Vs, a horizontal scan signal Hs, and a dot clock signal DCLK supplied from upper-level units not shown. In addition, the control circuit also generates a signal NRG which reaches an H level during a precharge period of a horizontal flyback period or a signal ENB for narrowing the pulse width of sampling signals.

The image-signal processing circuit 300 comprises a D/A conversion circuit 302, an S/P conversion circuit 304, and a precharge-voltage generating circuit 306. The D/A conversion circuit 302 converts digital image signals VID supplied from an upper-level unit not shown into analog image signals in synchronism with the vertical scan signal Vs, the horizontal scan signal Hs, and the dot clock signal DCLK (that is, in accordance with the vertical scan and the horizontal scan).

The S/P conversion circuit (distribution circuit) 304 receives the analog image signals, distributes the received analog image signals to six channels, expands (serial-to-parallel converts) the analog image signals to six times on the temporal axis, and then outputs the expanded analog image signals. Here, the reason for serial-parallel converting the image signals is to elongate the time when the image signals are applied through sampling switches 151 and to secure a sampling and holding time and a charging and discharging time.

The S/P conversion circuit 304 inverts the image signals requiring inversion of polarity among the serial-parallel converted image signals, and then properly amplifies the inverted image signals. Here, the inversion of polarity may be performed (1) in units of a scanning line, (2) in units of a data signal line, and (3) in units of a pixel, but for the purpose of convenient explanation in the present embodiment, the mode of performing the inversion of polarity (1) in units of a scanning line is exemplified. However, it is not intended to limit the present invention to this mode.

In the present embodiment, the image signals VID are converted into analog signals before the serial-parallel conversion, but the, analog conversion may be performed after the serial-parallel conversion, of course. In addition, in the present embodiment, the image signals of the six channels are simultaneously sampled into the data lines 114 included in the same block, but the image signals of the six channels may be sequentially shifted in synchronism with the dot clock and the image signals of the six channels may be sequentially sampled by a sampling circuit.

The precharge-voltage generating circuit 306 independently generates precharge voltages to the respective channels during the precharge period when the signal NRG reaches an H level. Specifically, the precharge-voltage generating circuit 306 sets the precharge voltage of an arbitrary channel to a voltage Vb+ corresponding to a black color during the front half of the precharge period before the positive writing and to a voltage Vg+ corresponding to a gray color during the rear half, while the precharge-voltage generating circuit sets the precharge voltage of an arbitrary channel to the voltage Vb− corresponding to a black color during the front half of the precharge period before the negative writing and to a voltage Vg− corresponding to a gray color during the rear half. The precharge-voltage generating circuit 306 can independently switch the timing of changing the voltage to the respective channels.

The switches 308 selects the image signals from the S/P conversion circuit 304 for the channels Ch1 to Ch6 when the signal NRG reaches an L level, selects the precharge voltages from the precharge-voltage generating circuit 306 when the signal NRG reaches an H level, and then the selected signals or voltages to the liquid crystal panel 100 as image signals VID1 to VID6.

Figure 2:
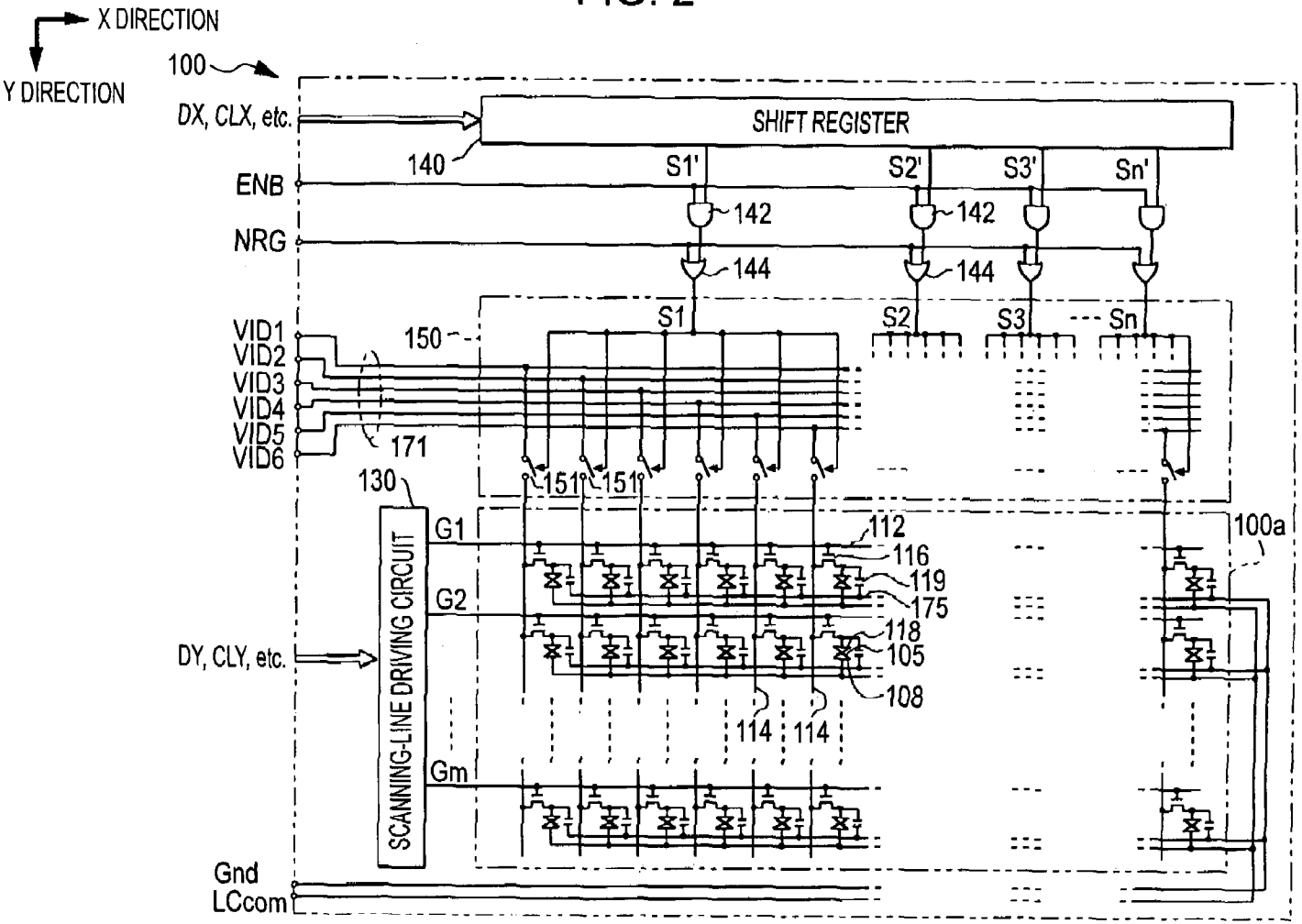
FIG. 2 is a block diagram illustrating a structure of a liquid crystal panel in the electro-optical device.
Figure 10:
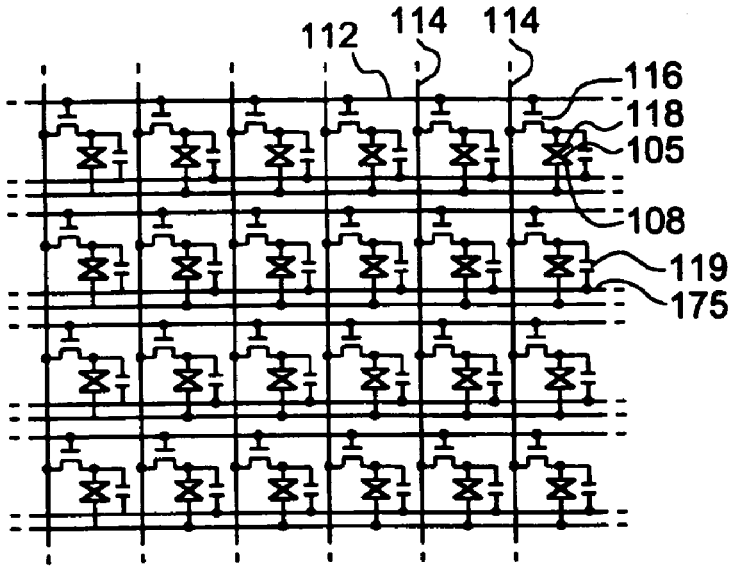
FIG. 10 is a diagram illustrating a structure of a conventional liquid crystal panel.
Figure 11:
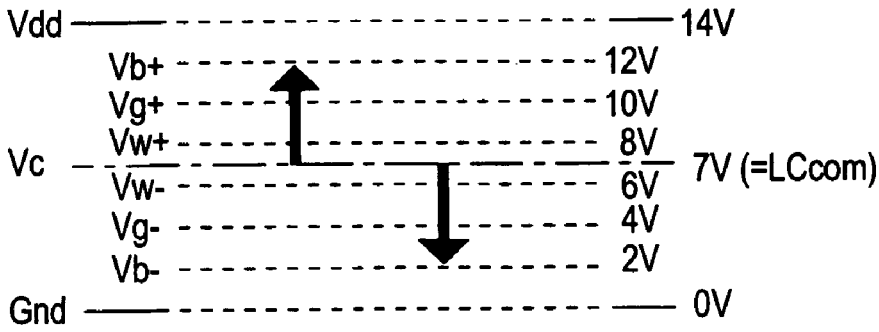
FIG. 11 is an explanatory diagram illustrating an AC driving of a liquid crystal panel.
Figure 12:
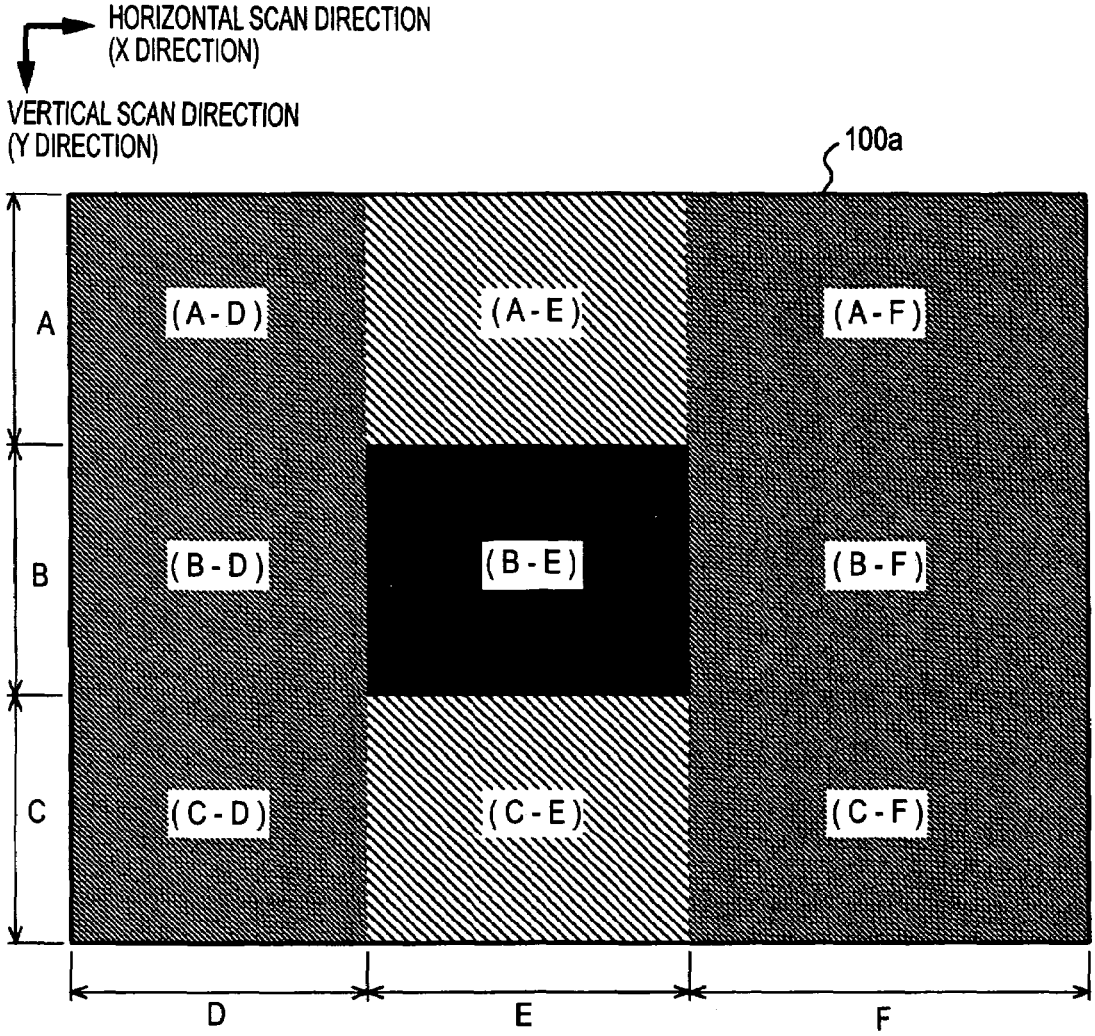
FIG. 12 is a diagram illustrating a vertical cross-talk in a liquid crystal panel.
Figure 13:
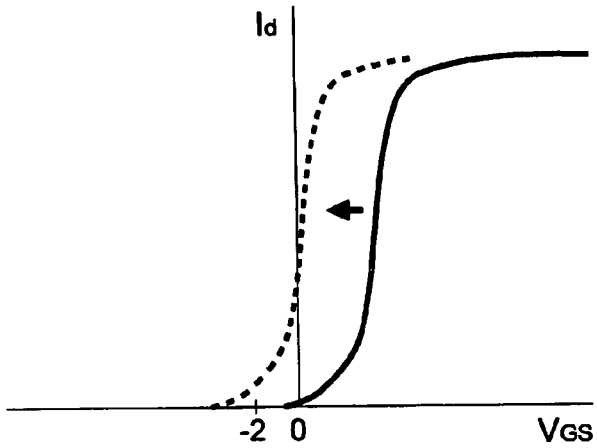
FIG. 13 is a diagram illustrating leakage of light from a TFT in a liquid crystal panel.
Figure 14:
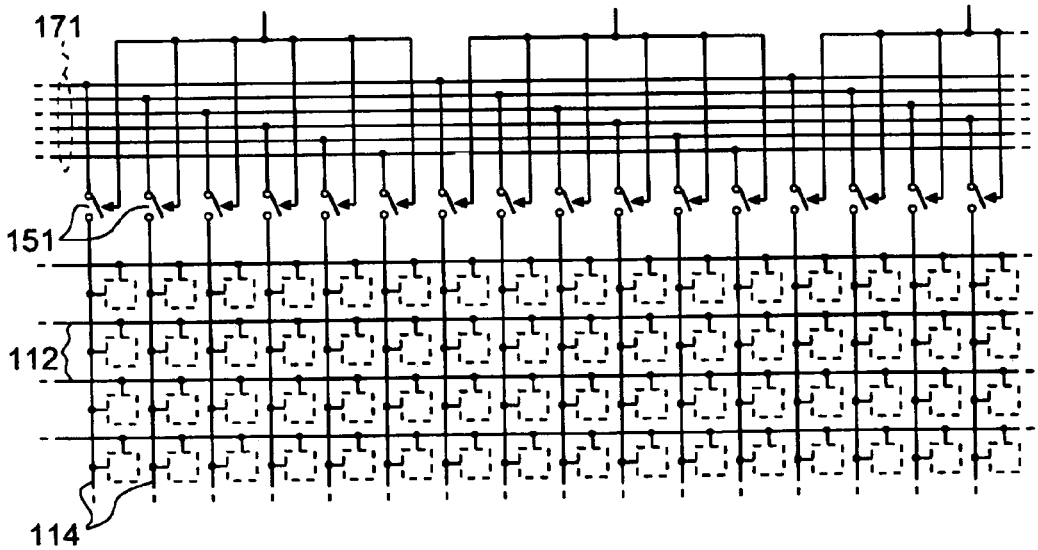
FIG. 14 is a diagram illustrating a phase-developing structure.

Next, a structure of the liquid crystal panel 100 will be described. FIG. 2 is a block diagram illustrating an electrical structure of the liquid crystal panel 100. Since the display area 100*a* of the liquid crystal panel 100 of the figure has the same structure as that shown in FIG. 10, peripheries of the display area 100*a* will be mainly described.

The outside of the display area 100*a* is provided with a scanning-line driving circuit 130, a shift register 140, a sampling circuit 150, etc. The scanning-line driving circuit 130 sequentially outputs the scan signals G1, G2, . . . , Gm, which would exclusively reach an active level (H level) only during one horizontal effective display period, during every horizontal scan period (1H). Details of the scanning-line driving circuit 130 are not shown since they are not related directly to the present invention. However, the scanning-line driving circuit sequentially shifts a transmission start pulse DY which is first supplied during one vertical scan period whenever the level of a clock signal CLY changes, and then shapes the waveform thereof, thereby generating the scan signals G1, G2, . . . , Gm.

Figure 3:
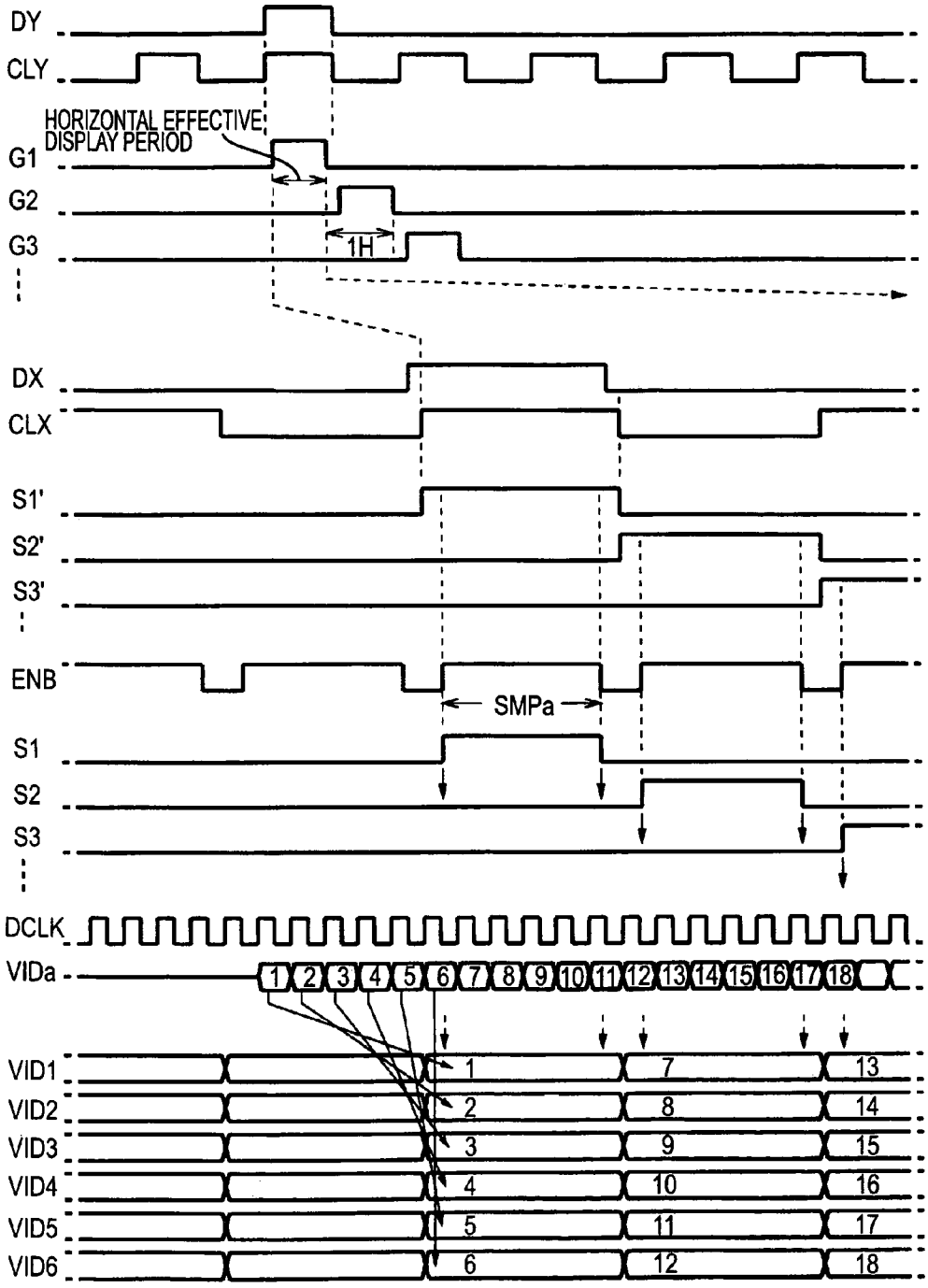
FIG. 3 is a timing chart illustrating operation of the electro-optical device.

As shown in FIG. 3, the shift register 140 sequentially shifts a transmission start pulse DX which is first supplied during one horizontal effective display period whenever the level of a clock signal CLX changes (rises or lowers), thereby outputting signals S1', S2', S3', . . . , Sn' correspondingly to the blocks of data lines.

AND circuits 142 are provided at respective output terminals of the shift register 140 and output logical product signals of the signals from the output terminal and the signal ENB. Accordingly, the signals from the respective output terminals of the shift register 140 can be narrowed into the pulse width SMPa of the signal ENB such that the adjacent signals are not overlapped.

OR circuits 144 outputs a logical sum signal of the logical product signal from the AND circuit 142 and the signal NRG. In this way, the signals S1', S2', S3', . . . , Sn' from the shift register 140 are output finally as the sampling signals S1, S2, S3, . . . , and Sn via the AND circuits 142 and the OR circuits 144.

The sampling circuit 150 samples the image signals VID1 to VID6 of the six channels, which are supplied through six image-signal lines 171, into the respective data lines 114 in accordance with the sampling signals S1, S2, S3, . . . , Sn, and comprises a sampling switch 151 provided at each data line 114.

Here, the data lines 114 are classified into blocks in units of six data lines, and the sampling switch 151 connected to one end of the data line 114 positioned at the leftmost among the six data lines 114 belonging to an i-th block (where i is 1, 2, . . . , n) from the left end of FIG. 2 samples the image signal VID1 supplied through the image-signal line 171 during the time when the sampling signal Si reaches an active level, and supplies the sampled image signal to the data line 114. The sampling switch 151 connected to one end of the data line 114 positioned at the second position from the leftmost in the block samples the image signal VID2 during the time when the sampling signal Si reaches an active level, and supplies the sampled image signal to the data line 114. Similarly, the respective sampling switches 151 connected to one end of the data lines 114 positioned at the third, fourth, fifth, and sixth positions among the six data lines 114 belonging to the block sample the image signals VID3, VID4, VID5, and VID6 during the time when the sampling signal Si reaches an active level, respectively, and supply the sampled image signals to the corresponding data lines 114.

Therefore, the shift register 140, the AND circuits 142, and the sampling circuit 150 constitute the data-line driving circuit for sampling the image signals into the data lines 114. In the present embodiment, since the TFT constituting the sampling switch 151 is an N channel type, the corresponding sampling switches 151 are turned on when the sampling signals S1, S2, . . . , Sn reach an H level. The TFT constituting the sampling switch 151 may be a P channel type or a complementary type combining both channel types.

Constituent elements of the scanning-line driving circuit 130, the shift register 140, the AND circuits 142, the OR circuits 144, and the sampling switches 151 are formed using the manufacturing processes common to the TFTs 116 for driving the pixels, thereby contributing to decrease in size of the entire device or reduction in cost.

Next, operation of the electro-optical device will be described. During the vertical scan period, the transmission start pulse DY is first supplied to the scanning-line driving circuit 130. As a result of this supply, as shown in FIG. 3, the scan signals G1, G2, G3, . . . , Gm sequentially exclusively reach an active level and are output to the respective scanning lines 112.

Figure 4A:
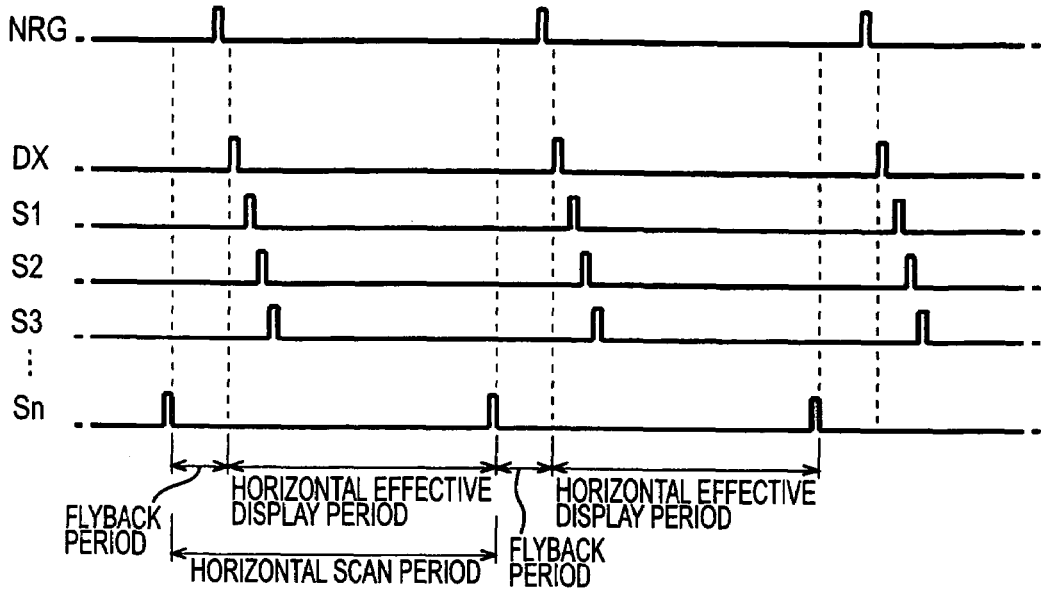
FIG. 4 is a timing chart illustrating operation of the electro-optical device.
Figure 4B:
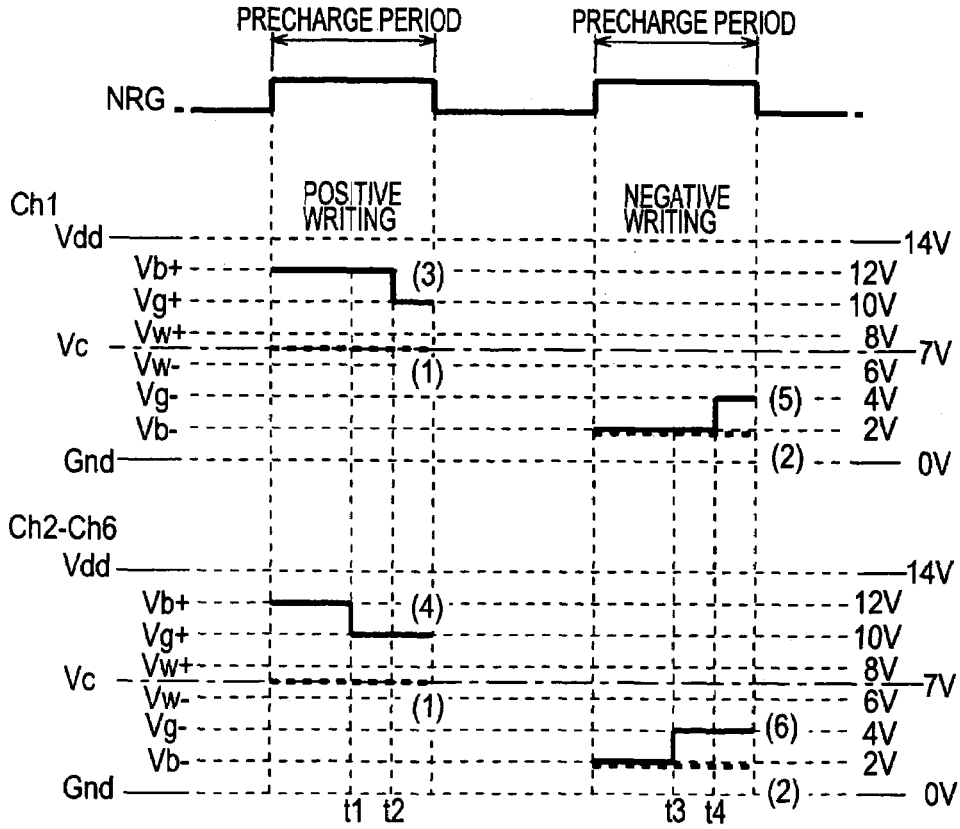

Here, paying attention to the horizontal effective display period when the scan signal G1 reaches an active level, in the flyback period before the horizontal effective display period, as shown in FIG. 4A, the signal NRG reaches an H level during the precharge period separated from the front and rear ends of the flyback period. First, since it is necessary to know whether any unevenness of display occurs in the liquid crystal panel 100, the precharge-voltage generating circuit 306 does not change the precharge voltage. That is, as shown in FIG. 4B, the precharge-voltage generating circuit 306 keeps the precharge voltage of the channels Ch1 to Ch6 constant as the voltage Vc corresponding to the positive writing during the precharge period.

When the signal NRG reaches an H level, the switches 308 select the precharge voltage from the precharge-voltage generating circuit 306, so that the voltages of the six image-signal lines 171 become the voltage Vc. When the signal NRG reaches an H level, the logical product signal of the OR circuit 144 reaches an H level regardless of the level of the logical product signal from the AND circuit 142, so that all the sampling switches 151 are turned on. Therefore, when the signal NRG reaches an H level, all the data lines 114 are precharged with the precharge voltage from the precharge-voltage generating circuit 306 and are precharged to the voltage Vc corresponding to the positive writing herein. Accordingly, the precharge-voltage generating circuit 306, the switches 308, the image-signal lines 171, the OR circuits 144, and the sampling circuit 150 constitute the precharge circuit for the data lines 114.

Next, when the flyback period is finished, the horizontal effective display period is started, and thus the scan signal G1 reaches an active level, the transmission start pulse DX is first supplied to the shift register 140, as shown in FIGS. 3 and 4A. Accordingly, the signals S1', S2', S3', . . . , Sn' are output from the shift register 140. The signals S1', S2', S3', . . . , Sn' are subjected to the logical product together with the signal ENB in the AND circuits 142, and then the sampling signals S1, S2, S3, . . . , Sn, which are narrowed into a period SMPa such that the adjacent pulse widths are not overlapped, are sequentially output.

On the other hand, the image signals VID supplied in synchronism with the horizontal scan are first converted into analog signals by the D/A converting circuit 302. Second, by the S/P conversion circuit 304, the analog signals are distributed into the six channels are expanded to six times on the temporal axis, are positively converted about the voltage Vc and then output correspondingly to the positively writing. As a result, the output voltage from the S/P conversion circuit becomes higher than the voltage Vc as the pixels displays a black color.

During the horizontal effective scan period, the signal NRG reaches an L level, and thus the switches 308 select the output from the S/P conversion circuit 304. For this reason, the signals VID1 to VID6 supplied to the six image-signal lines 171 are the image signals converted by the S/P conversion circuit 304.

In the horizontal effective scan period when the scan signal G1 reaches an active level, when the sampling signal S1 reaches an active level, the corresponding image signals VID1 to VID6 are sampled into the six data lines 114 belonging to the first block from the leftmost. The sampled image signals VID1 to VID6 are applied to the pixel electrodes 118 of the pixels positioned at the intersections between the first scanning line 112 from the uppermost in FIG. 2 and the six data lines 114, respectively.

Thereafter, when the sampling signal S2 reaches an active level, the image signals VID1 to VID6 are sampled into the six data lines 114 belonging to the second block in turn, and the image signals VID1 to VID6 are applied to the corresponding pixel electrodes 118 of the pixels positioned at the intersections between the first scanning line 112 and the six data lines 114, respectively.

Similarly, when the sampling signals S3, S4, . . . , Sn sequentially reach an active level, the image signals VID1 to VID6 are sampled into the six data lines 114 belonging to the third, fourth, . . . , n-th blocks, respectively, and the image signals VID1 to VID6 are applied to the corresponding pixel electrodes 118 of the pixels positioned at the intersections between the first scanning line 112 and the six data lines 114. Therefore, the writing to all the pixels of the first row is finished.

Subsequently, a period when the scan signal G2 reaches an active level will be described. In the present embodiment, as described above, since the inversion of polarity is carried out in units of a scanning line, the negative writing is carried out during the horizontal scan period.

Here, first paying attention to the horizontal effective display period when the scan signal G1 reaches an active level, when the signal NRG reaches an H level during the precharge period of the flyback period before the horizontal effective display period of the negative writing, the precharge-voltage generating circuit 306 sets the precharge voltage for all the channels Ch1 to Ch6 to the voltage Vb− corresponding to the negative writing during the precharge period, as indicated by (2) in FIG. 4B.

On the other hand, since the switches 308 selects the precharge voltage from the precharge-voltage generating circuit 306, the six image-signal lines 171 become Vb− and the logical product signals of the OR circuits 144 reach an H level, so that all the sampling switches 151 are turned on. As a result, all the data lines 114 are precharged to the voltage Vb− corresponding to the negative writing.

For other operation, similarly to the period when the scan signal G1 becomes active, the sampling signals S1, S2, S3, . . . , Sn sequentially reach an active level, thereby completing the writing to all the pixels of the second row. However, since the signals distributed into six channels and expanded to six times on the temporal axis are inverted about the voltage Vc and output from the S/P conversion circuit 304 correspondingly to the negative writing, the voltage becomes lower than the voltage Vc as the pixels are closer to the black color.

Similarly, the scan signals G3, G4, . . . , Gm become active, and the writing to the pixels of the third row, the fourth row, . . . , the m-th row is performed. As a result, the positive writing is performed to the pixels of the odd rows, while the negative writing is performed to the pixels of the even rows. Accordingly, during the vertical scan period, the writing to all the pixels of the first to m-th rows is completed.

During the next vertical scan period, the similar writing is performed, but at this time, the writing polarities to the pixels of the respective rows are changed. That is, during the next vertical scan period, the negative writing is performed to the pixels of the odd rows, while the positive writing is performed to the pixels of the even rows. In this way, since the writing polarities to the pixels are changed at every vertical scan period, DC components are not applied to the liquid crystal 105, thereby preventing deterioration of the liquid crystal 105.

Figure 5A:
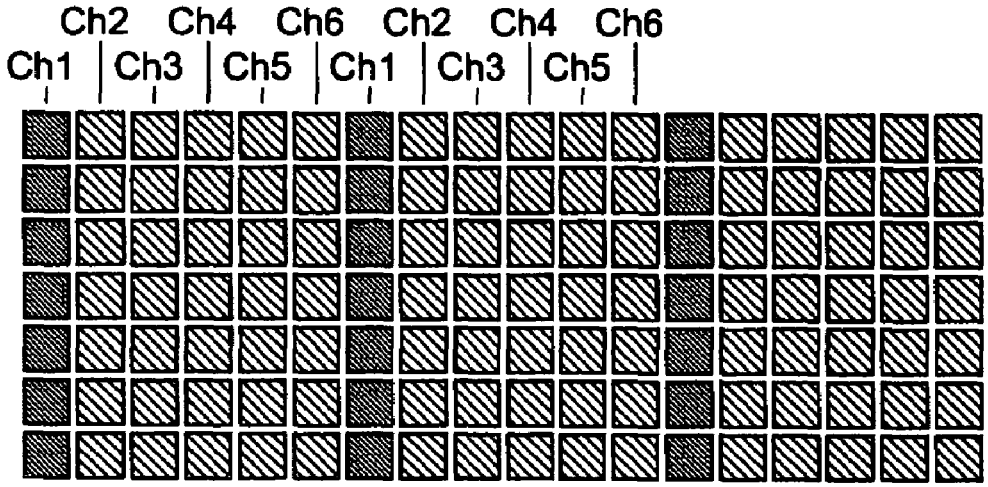
FIG. 5 is a diagram illustrating examples of a display in the electro-optical device.

In the displayed image shown in FIG. 5A, when the pixels of the data line 114 positioned at the leftmost in each block, that is, the pixels of the data line 114 to which the image signal of the channel Ch1 is supplied is darker than the pixels positioned at the other data lines 114, the precharge-voltage generating circuit 306 is set to change the following precharge voltage at the following timing with respect to the channels Ch1 to Ch6.

That is, for the positive writing, the precharge-voltage generating circuit 306 sets the channel Ch1 to the voltage Vb+ corresponding to a black color first during the precharge period as indicated by (3) in FIG. 4B and thereafter switches the channel to the voltage Vg+ corresponding to a gray color at the timing t2, while the switching timing from the voltage Vb+ to the voltage Vg+ for the other channels Ch2 to Ch6 is earlier than the timing t1 as indicated by (4) in FIG. 4B. Furthermore, for the negative writing, the precharge-voltage generating circuit 306 sets the channel Ch1 to the voltage Vb− corresponding to a black color first during the precharge period as indicated by (5) in FIG. 4B and thereafter switches the channel to the voltage Vg− corresponding to a gray color at the timing t4, while the switching timing from the voltage Vb− to the voltage Vg− for the other channels Ch2 to Ch6 is earlier than the timing t3 as indicated by (6) in FIG. 4B.

Figure 5B:
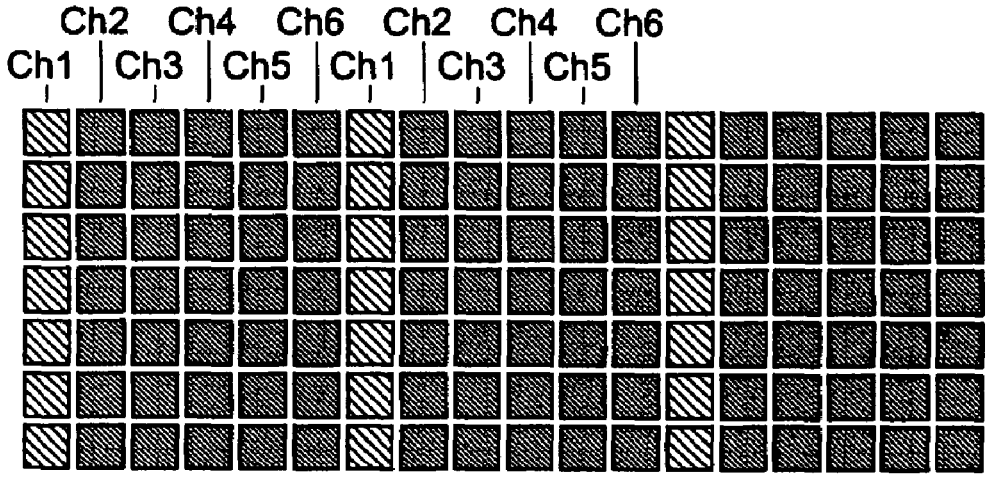
Figure 5C:
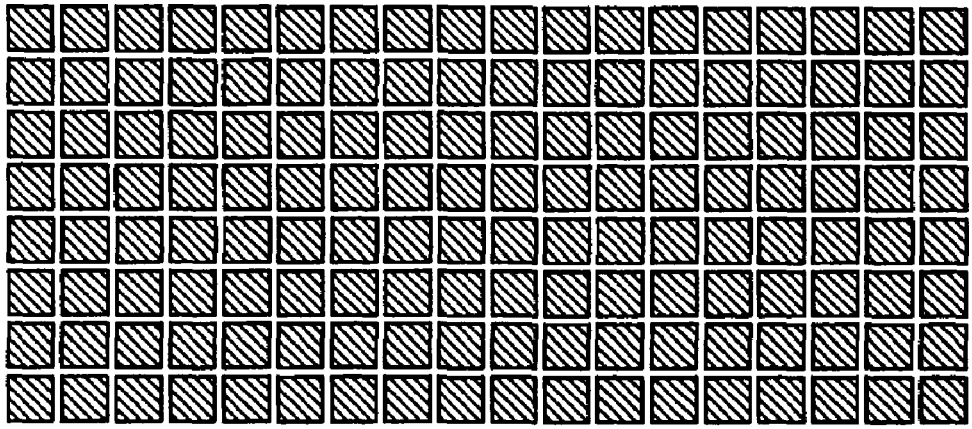

The period when the voltage Vb− corresponding to a black color of the negative writing is applied as the precharge voltage to the data line 114 to which the image signal of the channel Ch1 is supplied is longer than those of the data lines 114 to which the image signals of the channels Ch2 to Ch6. For this reason, since the liquid crystal capacitor of the pixels positioned at the data line 114 of the channel Ch1 has the effective voltage value lower than those of the liquid crystal capacitor of the pixels positioned at the data lines 114 of the channels Ch2 to Ch6 due to the leakage of light, as shown in FIG. 5B, the pixels corresponding to the Ch1 become brighter than the pixels corresponding to the channels Ch2 to Ch6. Therefore, the vertical stripe pattern which was originally generated as shown in FIG. 5A is erased as a result of synchronization with the image shown in FIG. 5B, so that the vertical stripe pattern disappears as shown in FIG. 5C.

Since in all the channels Ch1 to Ch6, the voltage corresponding to a gray color is Vg+ or Vg− at the end of the precharge period, the ideal state is obtained as described above and then the writing of the voltage corresponding to a gray color can be performed rapidly and accurately, so that it is possible to enhance reproducibility of an intermediate grayscale level.

As for the precharge voltage to the data line 114 having pixels darker than other pixels, it is possible to correct the pixels positioned on the data line 114 to be brighter, by elongating the time when the voltage Vb− is applied as the precharge voltage. However, at the ending of the precharge period, the voltage Vg− corresponding to a gray color may be applied. When the switching timing from the voltage Vb− corresponding to a black color to the voltage Vg− corresponding to a gray color is determined for each channel for the negative writing, the waveform of the precharge voltage for the positive writing may be obtained by inverting the waveform of the determined precharge voltage about the voltage Vc.

In the present embodiment, the switching timing of the precharge voltage for the channel Ch1 is different from the channels Ch2 to Ch6. This is because it is supposed that the unevenness of display generated before changing the precharge voltage is the same as that shown in FIG. 5A. Therefore, when the unevenness of display is different from that shown in FIG. 5A, the switching timing of the precharge voltage is naturally different from the present embodiment.

For example, when the pixels positioned on the data line 114 supplied with the image signal of the channel Ch6 is darker than the pixels positioned on the data lines 114 of the other channel Ch1 to Ch5, the switching timing of the precharge voltage for the channel Ch6 may be made to be later than those of the channels Ch1 to Ch5.

Figure 6A:
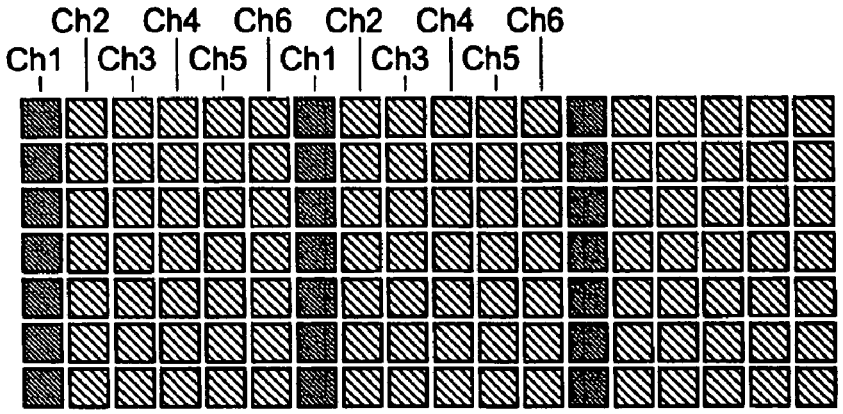
FIG. 6 is a diagram illustrating other examples of a display in the electro-optical device.
Figure 6B:
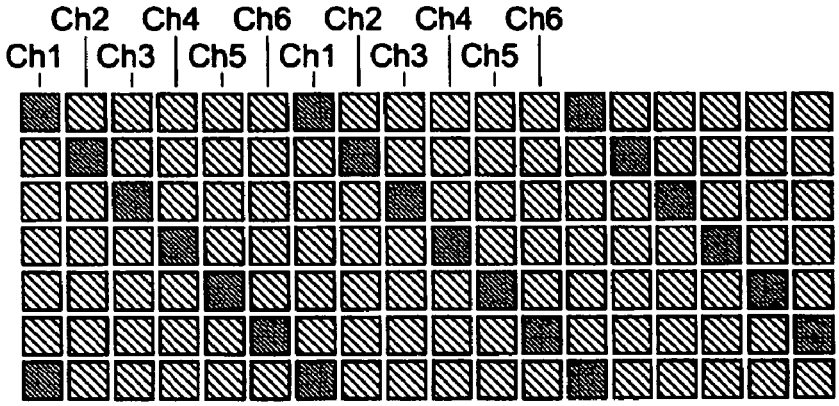
Figure 6C:
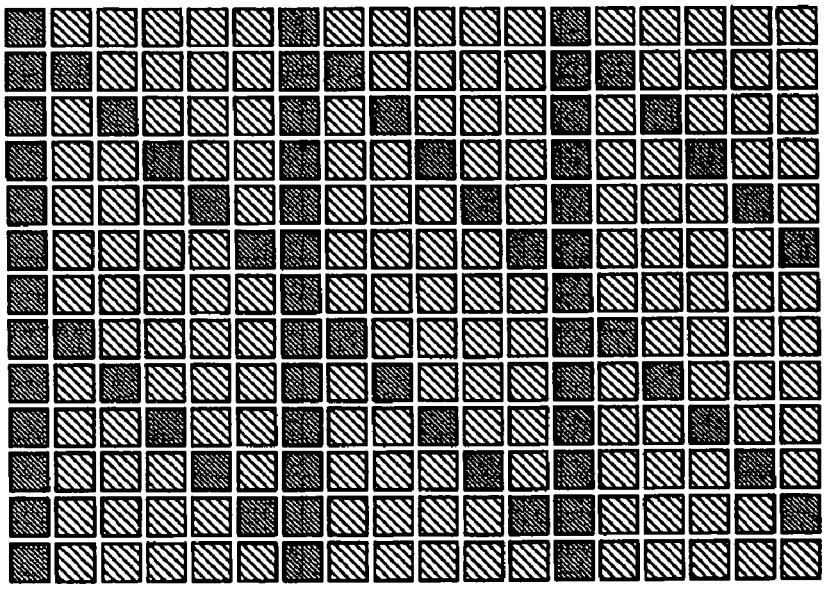

In order to remove the unevenness of display, instead of adjusting the switching timing of the precharge voltage, the unevenness of display may be made to be invisible by actively generating another unevenness of display. For example, when a vertical stripe pattern is generated as shown in FIG. 6A, the original vertical stripe pattern may be made to be invisible by actively generating an oblique stripe pattern as shown in FIG. 6B to form a synthesized image as shown in FIG. 6C. Vertical or horizontal stripe patterns are originally easily visible and remarkable. However, since the oblique stripe pattern generated with the same grayscale difference as the vertical stripe pattern is relatively invisible, the synthesis image of the vertical stripe pattern and the oblique stripe pattern is relatively invisible.

Here, in order to generate the oblique stripe pattern, the channels having different switching timings of the precharge voltage may be shifted during each horizontal scan period. Referring to FIG. 6B, the channel for which the switching timing from the voltage Vb−(Vb+) to the voltage Vg−(Vg+) is earlier, that is, the channel of which pixels are made to be dark by reducing influence of the leakage of light, may be sequentially shifted every horizontal scan period in the cycle of Ch1→Ch2→Ch3→Ch4→Ch5→Ch6→Ch1. Of course, the shift amount is not limited to one channel.

In the present embodiment, it has been supposed that the unevenness of display caused from the phase-developing structure, such as a vertical stripe pattern is statically (fixedly) generated, but it can be also considered that the unevenness of display is dynamically varied. Therefore, a structure, that image data, for example, corresponding to pixels of one row are temporarily stored, the display contents of the image data is analyzed, and the switching timings of the precharge voltages for the channels Ch1 to Ch6 are separately controlled to erase the unevenness of display to be generated in accordance with the analysis result, may be employed.

In the aforementioned embodiment, the vertical scan direction is a direction of G1→Gm and the horizontal scan direction is a direction of S1→Sn. However, in a case of a projector to be described later or a rotatable liquid crystal panel, it is necessary to invert the scan direction. However, since the image signals VID are supplied in synchronism with the vertical scan and the horizontal scan, it is not necessary to change the entire structure of the image-signal processing circuit 300.

In the aforementioned embodiment, the image signals VID1 to VID6 distributed into six channels are sampled into the six data lines 114 constituting one block, but the number of channels and the number of data lines to which simultaneous application is performed (that is, the number of data lines constituting one block) are not limited to "6" and may be two or more. For example, by setting the number of channels and the number of data lines subjected to simultaneous application to "3" or "12" or "24, " the corrected image signals having been distributed into 3 or 12 or 24 channels may be supplied to the 3 or 12 or 24 data lines. It is preferable for simplification of control or circuitry that the number of channels is a multiple of 3, considering that color image signals are related to three primary colors. However, when the electro-optical device is used for a simple optical modulation as performed in a projector to be described later, the multiple of 3 is not required.

On the other hand, although it has been described in the above embodiment that the image-signal processing circuit 300 processes the digital image signals VID, it may process analog image signals. Although the normally-white mode of performing the white display when the effective voltage value between the counter electrode 108 and the pixel electrodes 118 is small has been described in the aforementioned embodiment, a normally-black mode of performing the black display may be employed.

In the above embodiment, although the precharge signals is generated from the precharge-voltage generating circuit 306 and replaced with the image signals converted by the S/P conversion circuit 304, the data corresponding to the digital precharge signals may be overlapped with the digital image signals VID.

Moreover, in the aforementioned embodiment, a TN (Twisted Nematic) type liquid crystal is used as the liquid crystal, but a bi-stable type liquid crystal having a memory property such as a BTN (Bi-stable Twisted Nematic) ferroelectric type, a polymer distributed type liquid crystal, and a GH (Guest-Host) type liquid crystal in which dye molecules are aligned in parallel to the liquid crystal molecules by melting dye (guest), which anisotropically absorbs a visible ray in the major axis direction and the minor axis direction of the liquid crystal molecules, in a liquid crystal (host) having a constant molecule alignment may be employed.

A vertical alignment (homeotropic alignment) in which the liquid crystal molecules are aligned in a direction perpendicular to both substrates at the time of non-application of voltage and the liquid crystal molecules are aligned in a direction parallel to both substrates at the time of application of voltage may be employed. Further, a parallel (horizontal) alignment (homogeneous alignment) in which the liquid crystal molecules are aligned in a direction parallel to both substrates at the time of non-application of voltage and the liquid crystal molecules are aligned in a direction perpendicular to both substrates may be also employed. In this way, the present invention may employ various kinds of liquid crystal or alignment schemes.

<Electronic Apparatus>

Next, several electronic apparatuses having the electro-optical device according to the above embodiment will be described.

(Projector)

Figure 7:
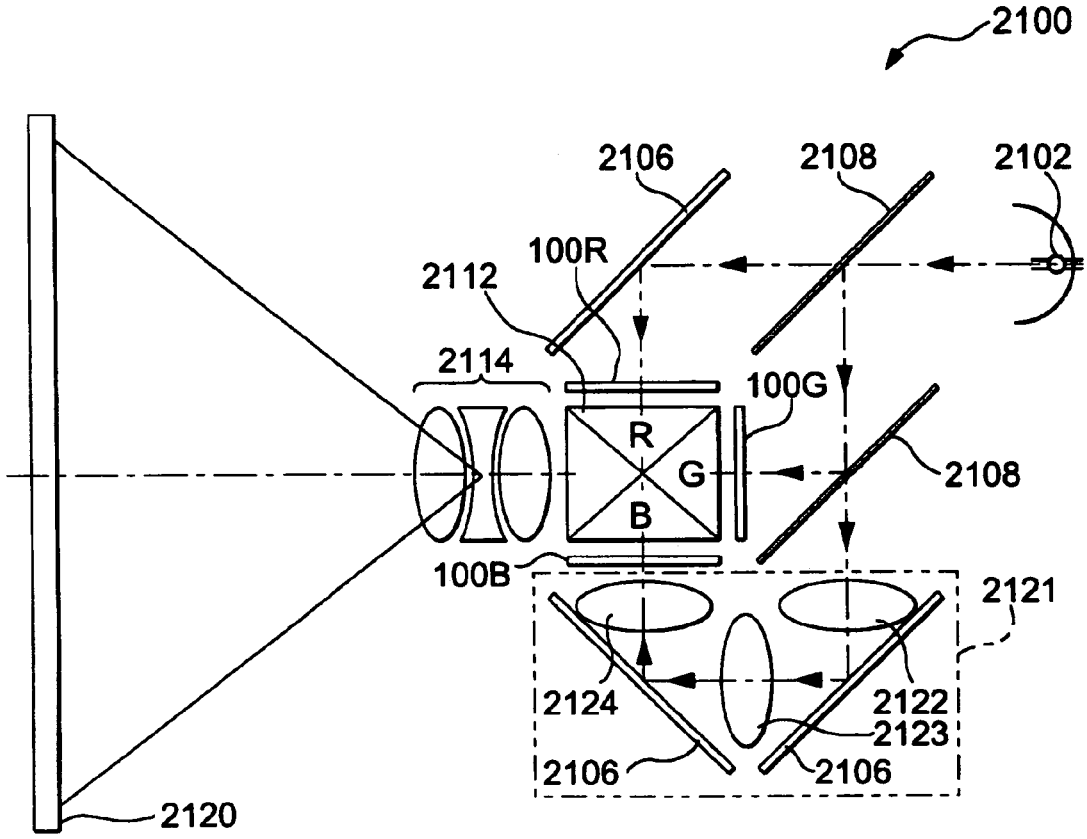
FIG. 7 is a cross-sectional view illustrating a projector which is an example of an electronic apparatus having the electro-optical device according to an embodiment.

First, a projector having the aforementioned liquid crystal panel 100 as light valves will be described. FIG. 7 is a cross-sectional view illustrating a structure of the projector. As shown in the figure, a lamp unit 2102 comprising a white light source such as a halogen lamp, etc. is provided inside the projector 2100. The projection light emitted from the lamp unit 2102 is separated into three primary colors of R (red color), G (green color), and B (blue color) by three mirrors 2106 and two dichroic mirrors 2108 disposed therein, and is then guided to light valves 100R, 100G, and 100B corresponding to the respective primary colors. Since the light component of B color has an optical path longer than those of R color or G color, the light component of B color is guided through a relay lens system 2121 including an incident lens 2122, a relay lens 2123, and an emission lens 2124 so as to prevent loss thereof.

Here, the light valves 100R, 100G, and 100B have the same structure as that of the liquid crystal panel 100 according to the aforementioned embodiment, and are driven with the image signals corresponding to the respective colors R, G, and B supplied from the image-signal processing circuit (omitted in FIG. 7). That is, in the projector 2100, three electro-optical devices including the liquid crystal panel 100 are provided correspondingly to the respective colors R, G, and B, so that the unevenness such as a vertical stripe pattern, etc. of the respective liquid crystal panels corresponding to the colors is corrected to be invisible.

The light components modulated by the light valves 1000, 100G, and 100B, respectively, are incident on the dichroic prism 2112 from three directions. In the dichroic prism 2112, the light components of R color and B color are refracted by 90°, while the light component of G color goes straightly. Therefore, the images of the respective colors are synchronized, and then a color image is projected onto a screen 2120 through a projection lens 2114.

Since the light components corresponding to the respective primary colors R, G, and B are applied to the light valves 100R, 100G, and 100B through the dichroic mirror 2108, it is not necessary to provide the color filters described above. The images passing through the light valves 100R and 100B are reflected from the dichroic mirror 2112 and then projected, while the image passing through the light valve 100G is projected as it is. Therefore, the horizontal scan direction by the light valves 100R and 100B is opposite to the horizontal scan direction by the light valve 100G, so that the images of which the right and left sides are reversed are displayed.

(Mobile Computer)

Figure 8:
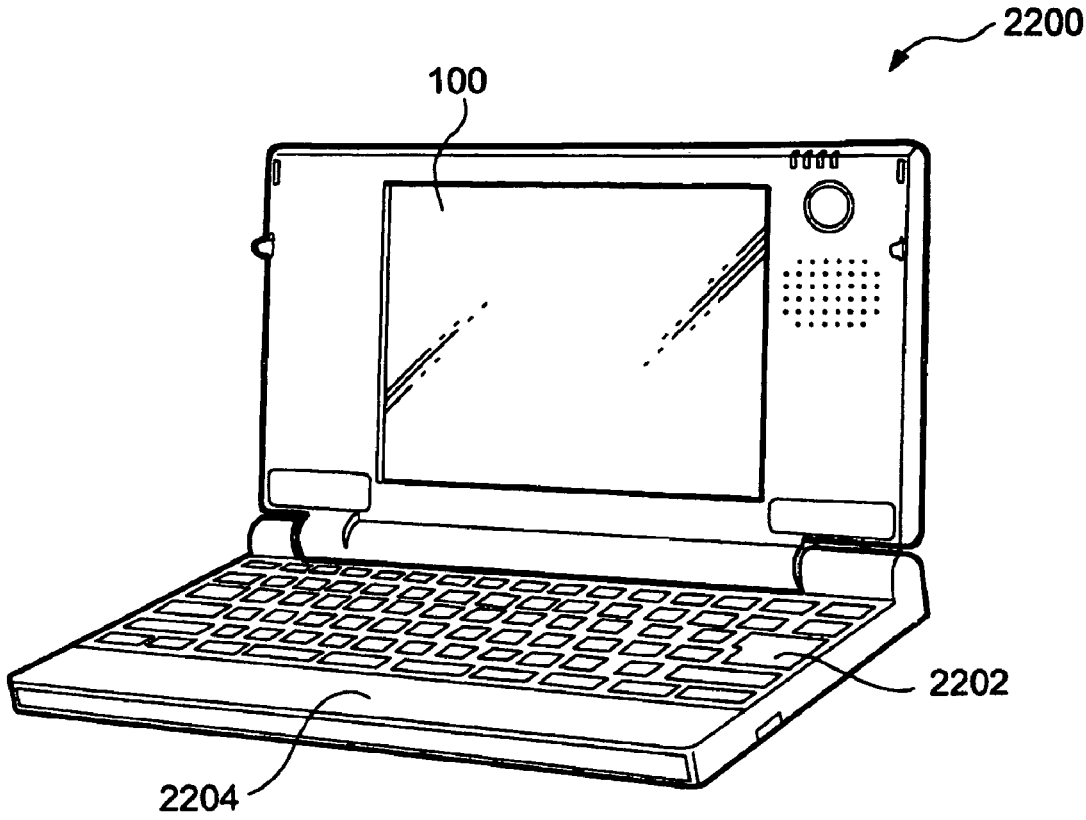
FIG. 8 is a perspective view illustrating a structure of a personal computer which is an example of an electronic apparatus having the electro-optical device according to an embodiment.

Next, an example where the aforementioned electro-optical device is applied to a mobile personal computer will be described. FIG. 8 is a perspective view illustrating a structure of the personal computer. In the figure, the computer 2200 comprises a main body 2204 having a keyboard 2202 and a liquid crystal panel 100 used as a display unit. The rear surface thereof is provided with a backlight unit (not shown) for enhancing visibility.

(Mobile Phone)

Next, an example where the aforementioned electro-optical device is applied to a display unit of a mobile phone will be described.

Figure 9:
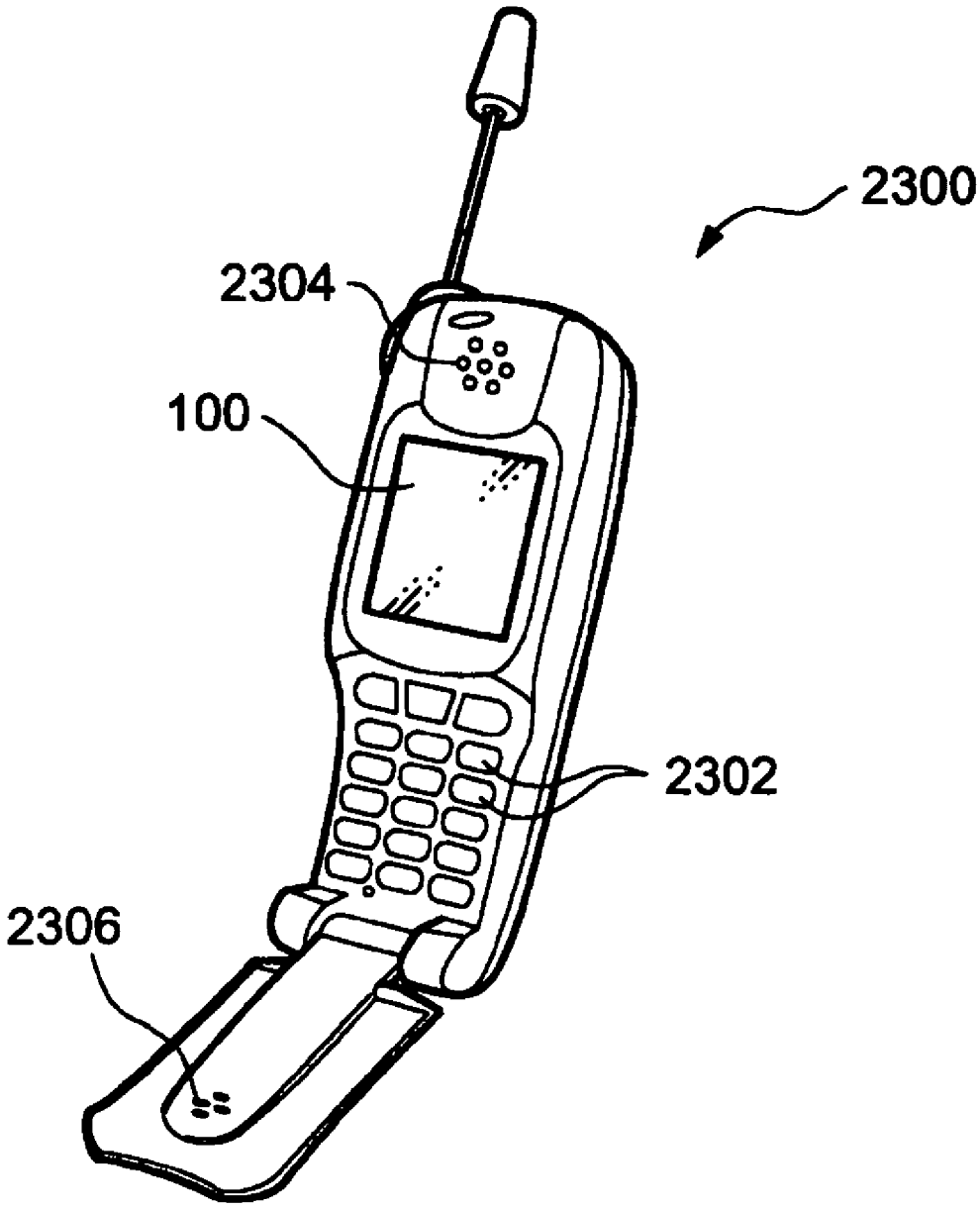
FIG. 9 is a perspective view illustrating a structure of a mobile phone which is an example of an electronic apparatus having the electro-optical device.

FIG. 9 is a perspective view illustrating a structure of the mobile phone. In the figure, the mobile phone 2300 comprises a plurality of manipulation buttons 2302, a receiver 2304, a transmitter 2306, and a liquid crystal panel 100 used as a display unit. The rear surface of the liquid crystal panel 100 is also provided with a backlight unit (not shown) for enhancing visibility.

(Other Electronic Apparatuses)

Examples of the electronic apparatus may include a television, a view finder type or monitor direct vision-type video tape recorder, a car navigation apparatus, a pager, an electronic pocket book, a calculator, a word processor, a work station, a television phone, a POS terminal, a digital still camera, an apparatus having a touch panel, and the like, in addition to the electronic apparatuses described with reference to FIGS. 7, 8, and 9. It is not to say that the display panel according to the present invention can be applied to the various electronic apparatuses.

What is claimed is:

1. A method of driving an electro-optical device having image-signal lines and a plurality of pixels arranged to correspond to intersections between a plurality of scanning lines and a plurality of data lines, the plurality of data lines being grouped into a predetermined number of blocks comprising a predetermined number of data lines, the method comprising:

precharging one of the data lines of a block to a first voltage during a first period and precharging the one of the data lines to a second voltage during a second period after the first period;

precharging another of the data lines of the block to a first voltage during a third period and precharging the other of the data lines to a second voltage during a fourth period after the third period, wherein:

the first period and the third period starting simultaneously, the third period being a different duration than the first period, the fourth period being a different duration than the second period, and a timing when the first voltage is switched to the second voltage in the one of the data lines of the block being later from a timing when the first voltage is switched to the second voltage in the other of the data lines of the block, selecting the plurality of scanning lines during a selection period after the precharging; and sampling image signals to the plurality of data lines through the image-signal lines simultaneously; and supplying the image signals to the pixels via the plurality of data lines during the selection period.

2. The method of driving an electro-optical device according to claim 1, wherein each of the pixels has a liquid crystal capacitor interposed between a pixel electrode and a counter electrode and a switching element electrically connecting each data line and the pixel electrode to each other when each corresponding scanning line is selected, and wherein when a voltage higher than a voltage of the counter electrode is written to the pixel electrode during an effective horizontal scan period, the first voltage is higher than the second voltage during a precharge period before the effective horizontal scan period, and when a voltage lower than the voltage of the counter electrode is written to the pixel electrode during the effective horizontal scan period, the first voltage is lower than the second voltage during the precharge period.

3. The method of driving an electro-optical device according to claim 1, wherein one image-signal line is changed during each precharge period.

4. The method of driving an electro-optical device according to claim 1, wherein the second voltage is a voltage corresponding to a voltage of an intermediate grayscale level between a highest grayscale level and a minimum grayscale level of pixels in image signals.

5. An electro-optical device having image-signal lines and a plurality of pixels arranged to correspond to intersections between a plurality of scanning lines and a plurality of data lines, the plurality of data lines being grouped into a predetermined number of blocks comprising a predetermined number of data lines, the electro-optical device comprising:

a precharge circuit which precharges one of the data lines of a block to a first voltage during a first period and precharges the one of the data lines to a second voltage during a second period after the first period and precharges another of the data lines of the block to a first voltage during a third period and precharges the other of the data lines to a second voltage during a fourth period after the third period, the first period and the third period starting simultaneously, the third period being a different duration than the first period, the fourth period being a different duration than the second period and a timing when the first voltage is switched to the second voltage in the one of the data lines of the block being later from a timing when the first voltage is switched to the second voltage in the other of the data lines of the block;

a scanning-line drive circuit which selects the plurality of scanning lines during a selection period after the second and the fourth period; and a data-line driving circuit which samples image signals to the plurality of data lines through the image-signal lines simultaneously and supplies the image signals to the pixels via the plurality of data lines during the selection period.

6. The electro-optical device according to claim 5, wherein each pixel has a liquid crystal capacitor interposed between a pixel electrode and a counter electrode and a switching element electrically connecting each data line and the pixel electrode to each other when each corresponding scanning line is selected, and wherein when a voltage higher than a voltage of the counter electrode is written to the pixel electrode during an effective horizontal scan period, the first voltage is higher than the second voltage during a precharge period before the effective horizontal scan period, and when a voltage lower than the voltage of the counter electrode is written to the pixel electrode during the effective horizontal scan period, the first voltage is lower than the second voltage during the precharge period.

7. The electro-optical device according to claim 5, wherein one image-signal line is changed during each precharge period.

8. An electronic apparatus having the electro-optical device according to claim 5.

* * * * *